US007295224B2

(12) United States Patent
Busch et al.

(10) Patent No.: US 7,295,224 B2
(45) Date of Patent: Nov. 13, 2007

(54) THERMAL RESPONSE CORRECTION SYSTEM

(75) Inventors: Brian D. Busch, Sudbury, MA (US); Suhail S. Saquib, Shrewsbury, MA (US); William T. Vetterling, Lexington, MA (US)

(73) Assignee: Polaroid Corporation, Waltham, MA (US)

( * ) Notice: Subject to any disclaimer, the term of this patent is extended or adjusted under 35 U.S.C. 154(b) by 267 days.

(21) Appl. No.: 10/831,925

(22) Filed: Apr. 26, 2004

(65) Prior Publication Data

US 2004/0196352 A1 Oct. 7, 2004

Related U.S. Application Data

(63) Continuation-in-part of application No. 09/934,703, filed on Aug. 22, 2001, now Pat. No. 6,819,347.

(51) Int. Cl.
*B41J 2/365* (2006.01)

(52) U.S. Cl. ..... 347/188; 347/189; 347/194

(58) Field of Classification Search ..... 347/19, 347/188, 189, 194; 400/120.09, 120.14
See application file for complete search history.

(56) References Cited

U.S. PATENT DOCUMENTS

| | | | | |
|---|---|---|---|---|
| 4,070,587 | A | 1/1978 | Hanakata | 307/141 |
| 4,284,876 | A | 8/1981 | Ishibashi et al. | 219/216 |
| 4,309,712 | A | 1/1982 | Iwakura | 346/76 |
| 4,347,518 | A | 8/1982 | Williams et al. | 346/1.1 |
| 4,364,063 | A | 12/1982 | Anno | 346/76 |
| 4,391,535 | A | 7/1983 | Palmer | 400/120 |
| 4,415,908 | A | 11/1983 | Sugiura | 346/76 |
| 4,443,121 | A | 4/1984 | Arai | 400/120 |
| 4,464,669 | A | 8/1984 | Sekiya et al. | 346/76 |
| 4,514,738 | A | 4/1985 | Nagato et al. | 346/76 |
| 4,524,368 | A | 6/1985 | Inui et al. | 346/76 |
| 4,563,691 | A | 1/1986 | Noguchi et al. | 346/76 |
| 4,607,262 | A | 8/1986 | Moriguchi et al. | 346/76 |
| 4,688,051 | A | 8/1987 | Kawakami et al. | 346/76 |
| 5,006,866 | A | 4/1991 | Someya | 346/76 |
| 5,066,961 | A | 11/1991 | Yamashita | 346/76 |
| 5,086,306 | A | 2/1992 | Sasaki | 346/76 |
| 5,115,252 | A | 5/1992 | Sasaki | 346/76 |
| 5,132,703 | A | 7/1992 | Nakayama | 346/76 |
| 5,132,709 | A | 7/1992 | West | 346/76 |
| 5,162,813 | A | 11/1992 | Kuroiwa et al. | 346/1.1 |
| 5,184,150 | A | 2/1993 | Sugimoto | 346/76 |
| 5,248,995 | A | 9/1993 | Izumi | 346/76 |
| 5,268,706 | A | 12/1993 | Sakamoto | 346/76 |

(Continued)

FOREIGN PATENT DOCUMENTS

EP 0 383 583 A1 8/1990

(Continued)

*Primary Examiner*—Huan Tran

(57) ABSTRACT

A model of a thermal print head is provided that models the thermal response of thermal print head elements to the provision of energy to the print head elements over time. The amount of energy to provide to each of the print head elements during a print head cycle to produce a spot having the desired density is calculated based on: (1) the desired density to be produced by the print head element during the print head cycle, (2) the predicted temperature of the print head element at the beginning of the print head cycle, (3) the ambient printer temperature at the beginning of the print head cycle, and (4) the ambient relative humidity.

6 Claims, 12 Drawing Sheets

U.S. PATENT DOCUMENTS

| | | | | |
|---|---|---|---|---|
| 5,422,662 | A | 6/1995 | Fukushima | 342/211 |
| 5,539,443 | A | 7/1996 | Mushika et al. | 347/194 |
| 5,575,745 | A | 11/1996 | Lin | 347/14 |
| 5,617,516 | A | 4/1997 | Barton | 395/113 |
| 5,623,297 | A | 4/1997 | Austin et al. | 347/194 |
| 5,625,399 | A | 4/1997 | Wiklof et al. | 347/195 |
| 5,642,148 | A | 6/1997 | Fukushima | 347/211 |
| 5,644,351 | A | 7/1997 | Matsumoto et al. | 347/194 |
| 5,646,672 | A | 7/1997 | Fukushima | 347/211 |
| 5,668,579 | A | 9/1997 | Fujii et al. | 347/10 |
| 5,706,044 | A | 1/1998 | Fukushima | 347/211 |
| 5,719,615 | A | 2/1998 | Hashiguchi et al. | 347/195 |
| 5,800,075 | A | 9/1998 | Katsuma et al. | 400/120 |
| 5,808,653 | A | 9/1998 | Matsumoto et al. | 347/194 |
| 5,841,461 | A | 11/1998 | Katsuma | 347/195 |
| 5,889,546 | A | 3/1999 | Fukuoka | 347/188 |
| 5,999,204 | A | 12/1999 | Kojima | 347/194 |
| 6,186,683 | B1 | 2/2001 | Shibuki | 400/120.8 |
| 6,537,410 | B2 | 3/2003 | Arnost et al. | 156/235 |
| 6,819,347 | B2 * | 11/2004 | Saquib et al. | 347/194 |
| 2003/0043251 | A1 | 3/2003 | Saquib et al. | 347/194 |
| 2005/0007438 | A1 * | 1/2005 | Busch et al. | 347/175 |
| 2005/0068404 | A1 * | 3/2005 | Saquib et al. | 347/194 |

FOREIGN PATENT DOCUMENTS

| | | |
|---|---|---|
| EP | 0 626 261 A2 | 11/1994 |
| EP | 0 626 261 A3 | 11/1994 |
| EP | 0 714 781 A2 | 6/1996 |
| EP | 0 714 781 A3 | 6/1996 |
| JP | 58-164368 | 9/1983 |
| JP | 59-127781 | 7/1984 |
| JP | 02162054 | 6/1990 |
| JP | 02-248264 | 10/1990 |
| JP | 02-289364 | 11/1990 |
| JP | 3-024972 | 2/1991 |
| JP | 03-024972 | 2/1991 |
| JP | H03-24972 | 2/1991 |
| WO | WO 03/018320 A1 | 3/2003 |

* cited by examiner

THERMAL RESPONSE CORRECTION SYSTEM

CROSS REFERENCE TO RELATED APPLICATIONS

This application is a continuation-in-part of U.S. patent application Ser. No. 09/934,703, filed on Aug. 22, 2001, entitled "Thermal Response Correction System," now U.S. Pat. No. 6,819,347 B2, which is hereby incorporated by reference.

BACKGROUND

1. Field of the Invention

The present invention relates to thermal printing and, more particularly, to techniques for improving thermal printer output by compensating for the effects of thermal history on thermal print heads.

2. Related Art

Thermal printers typically contain a linear array of heating elements (also referred to herein as "print head elements") that print on an output medium by, for example, transferring pigment or dye from a donor sheet to the output medium or by activating a color-forming chemistry in the output medium. The output medium is typically a porous receiver receptive to the transferred pigment, or a paper coated with the color-forming chemistry. Each of the print head elements, when activated, forms color on the medium passing underneath the print head element, creating a spot having a particular density. Regions with larger or denser spots are perceived as darker than regions with smaller or less dense spots. Digital images are rendered as two-dimensional arrays of very small and closely-spaced spots.

A thermal print head element is activated by providing it with energy. Providing energy to the print head element increases the temperature of the print head element, causing either the transfer of pigment to the output medium or the formation of color in the receiver. The density of the output produced by the print head element in this manner is a function of the amount of energy provided to the print head element. The amount of energy provided to the print head element may be varied by, for example, varying the amount of power to the print head element within a particular time interval or by providing power to the print head element for a longer time interval.

In conventional thermal printers, the time during which a digital image is printed is divided into fixed time intervals referred to herein as "print head cycles." Typically, a single row of pixels (or portions thereof) in the digital image is printed during a single print head cycle. Each print head element is typically responsible for printing pixels (or subpixels) in a particular column of the digital image. During each print head cycle, an amount of energy is delivered to each print head element that is calculated to raise the temperature of the print head element to a level that will cause the print head element to produce output having the desired density. Varying amounts of energy may be provided to different print head elements based on the varying desired densities to be produced by the print head elements.

One problem with conventional thermal printers results from the fact that their print head elements retain heat after the conclusion of each print head cycle. This retention of heat can be problematic because, in some thermal printers, the amount of energy that is delivered to a particular print head element during a particular print head cycle is typically calculated based on an assumption that the print head element's temperature at the beginning of the print head cycle is a known fixed temperature. Since, in reality, the temperature of the print head element at the beginning of a print head cycle depends on (among other things) the amount of energy delivered to the print head element during previous print head cycles, the actual temperature achieved by the print head element during a print head cycle may differ from the calibrated temperature, thereby resulting in a higher or lower output density than is desired. Further complications are similarly caused by the fact that the current temperature of a particular print head element is influenced not only by its own previous temperatures—referred to herein as its "thermal history"—but by the ambient (room) temperature and the thermal histories of other print head elements in the print head.

As may be inferred from the discussion above, in some conventional thermal printers, the average temperature of each particular thermal print head element tends to gradually rise during the printing of a digital image due to retention of heat by the print head element and the over-provision of energy to the print head element in light of such heat retention. This gradual temperature increase results in a corresponding gradual increase in density of the output produced by the print head element, which is perceived as increased darkness in the printed image. This phenomenon is referred to herein as "density drift."

Furthermore, conventional thermal printers typically have difficulty accurately reproducing sharp density gradients between adjacent pixels both across the print head and in the direction of printing. For example, if a print head element is to print a white pixel following a black pixel, the ideally sharp edge between the two pixels will typically be blurred when printed. This problem results from the amount of time that is required to raise the temperature of the print head element to print the black pixel after printing the white pixel. More generally, this characteristic of conventional thermal printers results in less than ideal sharpness when printing images having regions of high density gradient.

The above-referenced U.S. patent application Ser. No. 09/934,703, entitled "Thermal Response Correction System," discloses a model of a thermal print head that models the thermal response of thermal print head elements to the provision of energy to the print head elements over time. The thermal print head model generates predictions of the temperature of each of the thermal print head elements at the beginning of each print head cycle based on: (1) the current temperature of the thermal print head as measured by a temperature sensor, (2) the thermal history of the print head, and (3) the energy history of the print head. The amount of energy to provide to each of the print head elements during a print head cycle to produce a spot having the desired density is calculated based on: (1) the desired density to be produced by the print head element during the print head cycle, and (2) the predicted temperature of the print head element at the beginning of the print head cycle.

Although such techniques take the temperature of the print head into account when performing thermal history control, the techniques disclosed in the above-referenced patent application do not expressly take into account changes in ambient printer temperature over time when performing thermal history control. Similarly, any thermal effects of humidity are not expressly taken into account by the techniques disclosed in the above-referenced patent application.

What is needed, therefore, are improved techniques for taking into account the ambient printing conditions, so as to render digital images more accurately.

SUMMARY

A model of a thermal print head is provided that models the thermal response of thermal print head elements to the provision of energy to the print head elements over time. The amount of energy to provide to each of the print head elements during a print head cycle to produce a spot having the desired density is calculated based on: (1) the desired density to be produced by the print head element during the print head cycle, (2) the predicted temperature of the print head element at the beginning of the print head cycle, (3) the ambient printer temperature at the beginning of the print head cycle, and (4) the ambient relative humidity.

In one aspect of the present invention, a method is provided which includes steps of: (A) identifying a first print head temperature $T_s$ of a print head in a printer; (B) identifying a current ambient temperature $T_r$ in the printer; (C) identifying a modified print head temperature $T_s'$ based on the first print head temperature $T_s$ and the ambient printer temperature $T_r$; and (D) identifying an input energy to provide to a print head element in the print head based on the modified print head temperature $T_s'$. The step (D) may include a step of identifying the input energy to provide to the print head element based on the modified print head temperature $T_s'$ and a current relative humidity.

In another aspect of the present invention, a method is provided for use in conjunction with a thermal printer including a print head element. The method includes a step of: (A) computing an input energy to provide to the print head element based on a current temperature of the print head element, an ambient printer temperature, and a plurality of one-dimensional functions of a desired output density to be printed by the print head element.

In another aspect of the present invention, a method is provided for use in conjunction with a thermal printer having a print head including a plurality of print head elements. The method develops, for each of a plurality of print head cycles, a plurality of input energies to be provided to the plurality of print head elements during the print head cycle to produce a plurality of output densities. The method includes steps of: (A) using a multi-resolution heat propagation model to develop, for each of the plurality of print head cycles, a plurality of predicted temperatures of the plurality of print head elements at the beginning of the print head cycle; and (B) using an inverse media model to develop the plurality of input energies based on the plurality of predicted temperatures, a plurality of densities to be output by the plurality of print head elements during the print head cycle, and at least one ambient printer temperature.

Other features and advantages of various aspects and embodiments of the present invention will become apparent from the following description and from the claims.

DETAILED DESCRIPTION

Figure 1:
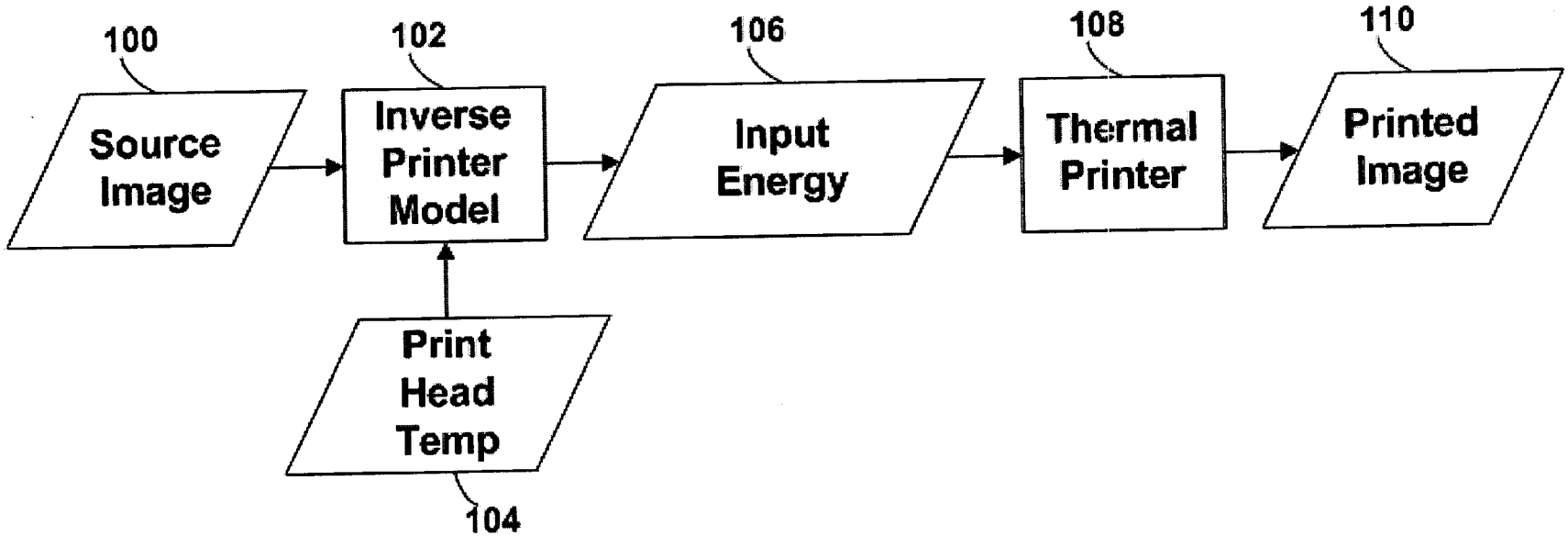
FIG. 1 is a data flow diagram of a system that is used to print digital images according to one embodiment of the present invention.

A model of a thermal print head is provided that models the thermal response of thermal print head elements to the provision of energy to the print head elements over time. The amount of energy to provide to each of the print head elements during a print head cycle to produce a spot having the desired density is calculated based on: (1) the desired density to be produced by the print head element during the print head cycle, (2) the predicted temperature of the print head element at the beginning of the print head cycle, (3) the ambient printer temperature at the beginning of the print head cycle, and (4) the ambient relative humidity.

The above-referenced patent application entitled "Thermal Response Correction System" disclosed a model of a thermal print head that models the thermal response of thermal print head elements to the provision of energy to the print head elements over time. The history of temperatures of print head elements of a thermal print head is referred to herein as the print head's "thermal history." The distribution of energies to the print head elements over time is referred to herein as the print head's "energy history."

In particular, the thermal print head model generates predictions of the temperature of each of the thermal print head elements at the beginning of each print head cycle based on: (1) the current temperature of the thermal print head, (2) the thermal history of the print head, and (3) the energy history of the print head. In one embodiment of the disclosed thermal print head model, the thermal print head model generates a prediction of the temperature of a particular thermal print head element at the beginning of a print head cycle based on: (1) the current temperature of the thermal print head, (2) the predicted temperatures of the print head element and one or more of the other print head elements in the print head at the beginning of the previous print head cycle, and (3) the amount of energy provided to the print head element and one or more of the other print head elements in the print head during the previous print head cycle.

In one embodiment disclosed in the above-referenced patent application, the amount of energy to provide to each of the print head elements during a print head cycle to produce a spot having the desired density is calculated based on: (1) the desired density to be produced by the print head element during the print head cycle, and (2) the predicted temperature of the print head element at the beginning of the print head cycle. It should be appreciated that the amount of energy provided to a particular print head element using such a technique may be greater than or less than that provided by conventional thermal printers. For example, a lesser amount of energy may be provided to compensate for density drift. A greater amount of energy may be provided to produce a sharp density gradient. The disclosed model is flexible enough to either increase or decrease the input energies as appropriate to produce the desired output densities.

Use of the thermal print head model decreases the sensitivity of the print engine to the ambient temperature and to previously printed image content, which manifests itself in the thermal history of the print head elements.

For example, referring to FIG. 1, a system for printing images is shown according to one embodiment of the present invention. The system includes an inverse printer model 102, which is used to compute the amount of input energy 106 to be provided to each print head element in a thermal printer 108 when printing a particular source image 100. As described in more detail below with respect to FIGS. 2 and 3, a thermal printer model 302 models the output (e.g., the printed image 110) produced by thermal printer 108 based on the input energy 106 that is provided to it. Note that the thermal printer model 302 includes both a print head temperature model and a model of the media response. The inverse printer model 102 is an inverse of the thermal printer model 302. More particularly, the inverse printer model 102 computes the input energy 106 for each print head cycle based on the source image 100 (which may, for example, be a two-dimensional grayscale or color digital image) and the current temperature 104 of the thermal printer's print head. The thermal printer 108 prints a printed image 110 of the source image 100 using the input energy 106. It should be appreciated that the input energy 106 may vary over time and for each of the print head elements. Similarly, the print head temperature 104 may vary over time.

In general, the inverse printer model 102 models the distortions that are normally produced by the thermal printer 108 (such as those resulting from density drift, as described above and those resulting from the media response) and "pre-distorts" the source image 100 in an opposite direction to effectively cancel out the distortions that would otherwise be produced by the thermal printer 108 when printing the printed image 110. Provision of the input energy 106 to the thermal printer 108 therefore produces the desired densities in the printed image 110, which therefore does not suffer from the problems (such as density drift and degradation of sharpness) described above. In particular, the density distribution of the printed image 110 more closely matches the density distribution of the source image 100 than the density distributions typically produced by conventional thermal printers.

Figure 2:
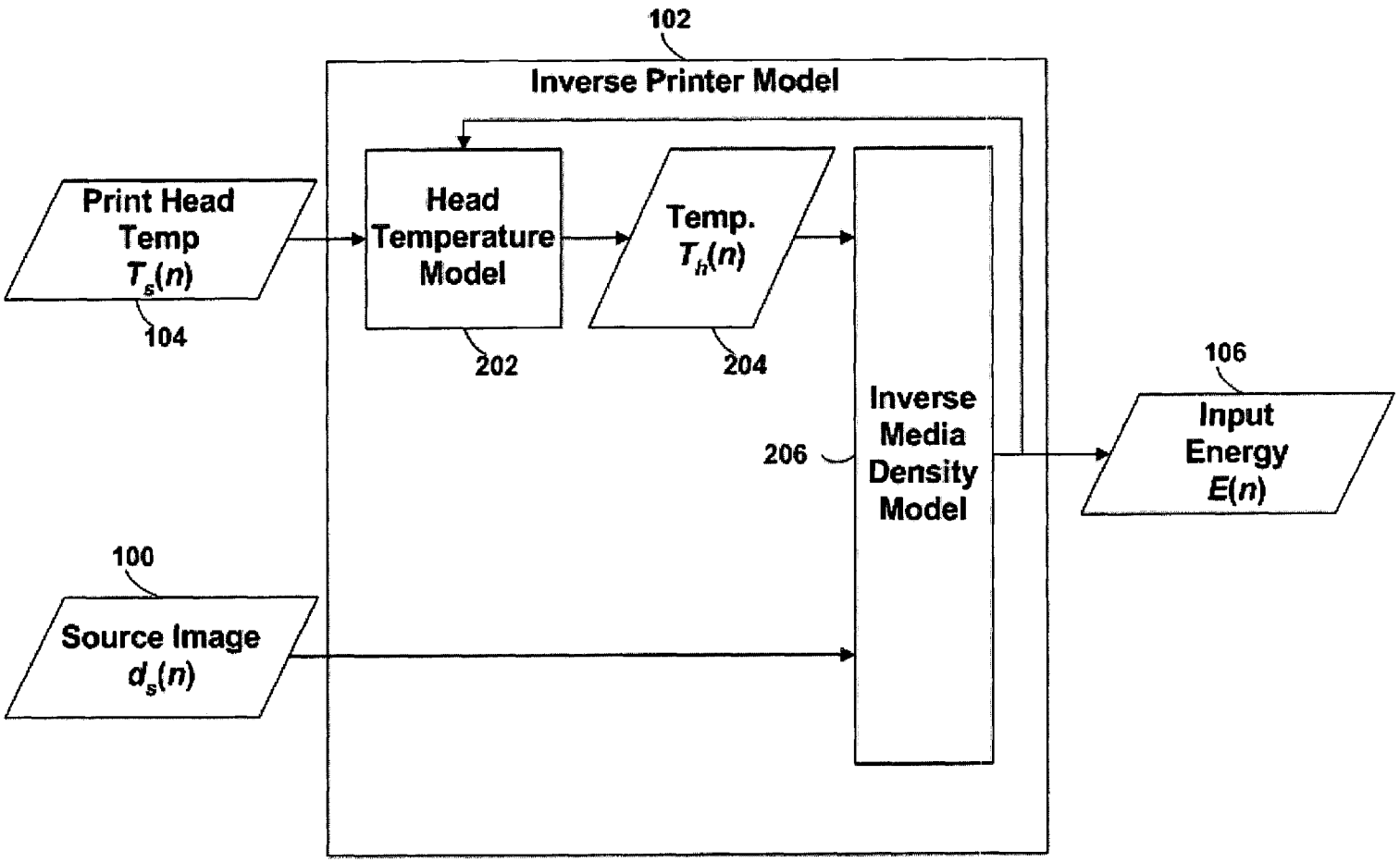
FIG. 2 is a data flow diagram of an inverse printer model used in one embodiment of the present invention.
Figure 3:
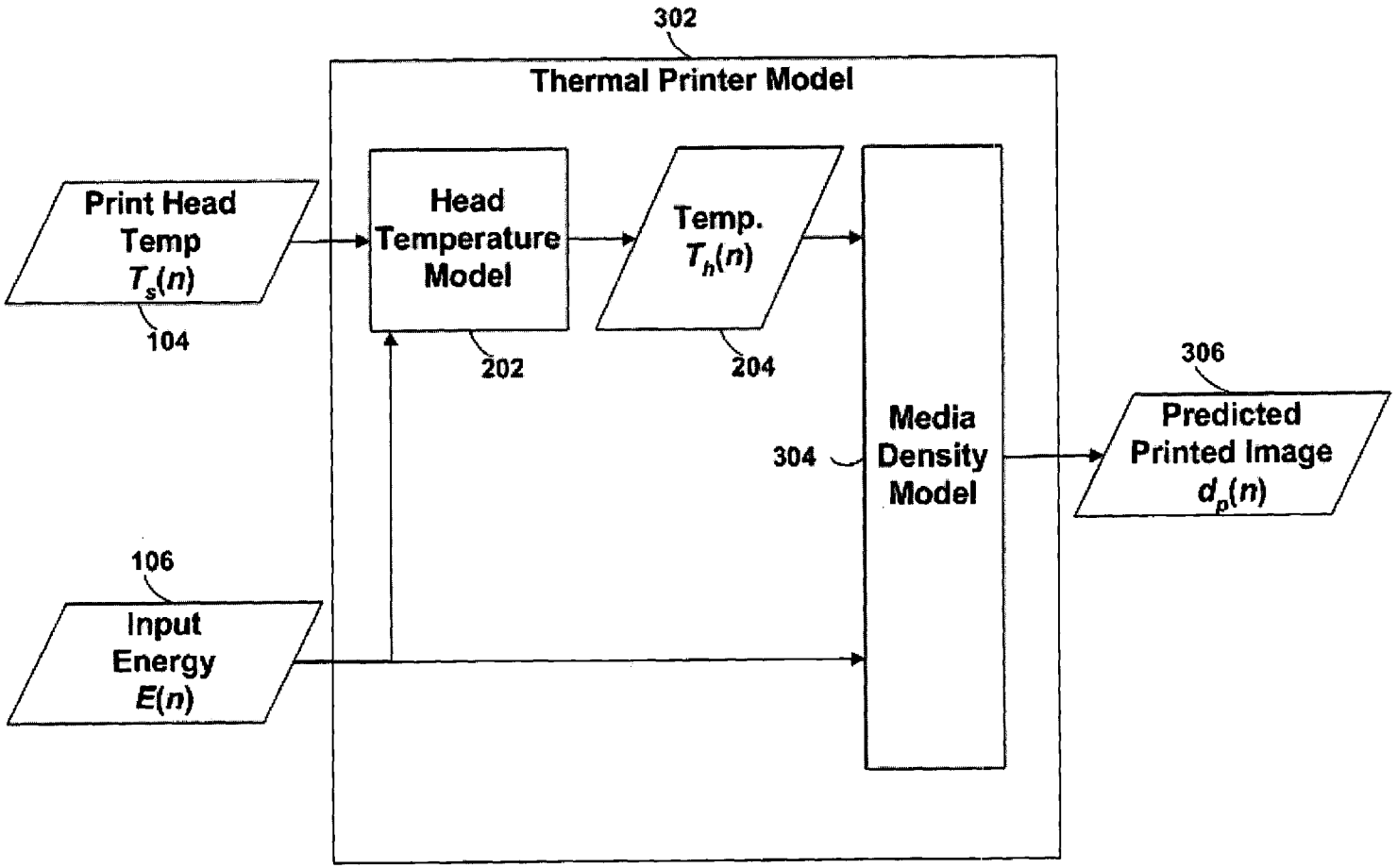
FIG. 3 is a data flow diagram of a thermal printer model used in one embodiment of the present invention.

As shown in FIG. 3, thermal printer model 302 is used to model the behavior of the thermal printer 108 (FIG. 1). As described in more detail with respect to FIG. 2, the thermal printer model 302 is used to develop the inverse printer model 102, which is used to develop input energy 106 to provide to the thermal printer 108 to produce the desired output densities in printed image 110 by taking into account the thermal history of the thermal printer 108. In addition, the thermal printer model 302 is used for calibration purposes, as described below.

Before describing the thermal printer model 302 in more detail, certain notation will be introduced. The source image 100 (FIG. 1) may be viewed as a two-dimensional density distribution $d_s$ having r rows and c columns. In one embodiment of the present invention, the thermal printer 108 prints one row of the source image 100 during each print head cycle. As used herein, the variable n will be used to refer to discrete time intervals (such as particular print head cycles). Therefore, the print head temperature 104 at the beginning of time interval n is referred to herein as $T_s(n)$. Similarly, $d_s(n)$ refers to the density distribution of the row of the source image 100 being printed during time interval n.

Similarly, it should be appreciated that the input energy 106 may be viewed as a two-dimensional energy distribution E. Using the notation just described, E(n) refers to the one-dimensional energy distribution to be applied to the thermal printer's linear array of print head elements during time interval n. The predicted temperature of a print head element is referred to herein as $T_h$ (referred to as $T_a$ in the above-referenced patent application). The predicted temperatures for the linear array of print head elements at the beginning of time interval n is referred to herein as $T_h(n)$.

As shown in FIG. 3, the thermal printer model 302 takes as inputs during each time interval n: (1) the temperature $T_s(n)$ 104 of the thermal print head at the beginning of time interval n, and (2) the input energy E(n) 106 to be provided to the thermal print head elements during time interval n. The thermal printer model 302 produces as an output a predicted printed image 306, one row at a time ($d_p(n)$). The thermal printer model 302 includes a head temperature model 202 (as described in more detail below with respect to FIG. 2) and a media density model 304. The media density model 304 takes as inputs the predicted temperatures $T_h(n)$ 204 produced by the head temperature model 202 and the input energy E(n) 106, and produces as an output the predicted printed image 306.

Referring to FIG. 2, one embodiment of the inverse printer model 102 is shown. The inverse printer model 102 receives as inputs for each time interval n: (1) the print head temperature 104 $T_s(n)$ at the beginning of time interval n, and (2) the densities $d_s(n)$ of the row of the source image 100 to be printed during time interval n. The inverse printer model 102 produces the input energy E(n) 106 as an output.

Inverse printer model 102 includes head temperature model 202 and an inverse media density model 206. In general, the head temperature model 202 predicts the temperatures of the print head elements over time while the printed image 110 is being printed. More specifically, the head temperature model 202 outputs a prediction of the temperatures $T_h(n)$ 204 of the print head elements at the beginning of a particular time interval n based on: (1) the current temperature of the print head $T_s(n)$ 104, and (2) the input energy E(n−1) that was provided to the print head elements during time interval n−1.

In general, the inverse media density model 206 computes the amount of energy E(n) 106 to provide to each of the print head elements during time interval n based on: (1) the predicted temperatures $T_h(n)$ 204 of each of the print head elements at the beginning of time interval n, and (2) the desired densities $d_s(n)$ 100 to be output by the print head elements during time interval n. The input energy E(n) 106 is provided to the head temperature model 202 for use during the next time interval n+1. It should be appreciated that the inverse media density model 206, unlike the techniques typically used by conventional thermal printers, takes both the current (predicted) temperatures $T_h(n)$ 204 of the print head elements and the temperature-dependent media response into account when computing the energy E(n) 106, thereby achieving an improved compensation for the effects of thermal history and other printer-induced imperfections.

Although not shown explicitly in FIG. 2, the head temperature model 202 may internally store at least some of the predicted temperatures $T_h(n)$ 204, and it should therefore be appreciated that previous predicted temperatures (such as $T_h(n-1)$) may also be considered to be inputs to the head temperature model 202 for use in computing $T_h(n)$ 204.

As described in the above-referenced patent application, the inverse media density model 206 receives as inputs during each time interval n: (1) the source image densities $d_s(n)$ 100, and (2) $T_h(n)$ 204, the predicted temperatures of the thermal print head elements at the beginning of time interval n. The inverse media density model 206 produces as an output the input energy E(n) 106.

In other words, the transfer function defined by the inverse media density model 206 is a two-dimensional function E=F(d,$T_h$). In one embodiment, the function E=F (d,$T_h$) described above is represented using Equation 1:

$$E=G(d)+S(d)T_h \quad \text{Equation 1}$$

This equation may be interpreted as the first two terms of a Taylor series expansion in $T_h$ for the exact energy that would provide the desired density. Such a representation may be advantageous for a variety of reasons. For example, a direct software and/or hardware implementation of E=F (d,$T_h$) as a two-dimensional function may require a large amount of storage or a significant number of computations to compute the energy E. In contrast, the one dimensional functions G(d) and S(d) may be stored as look-up tables using a relatively small amount of memory, and the inverse media density model 206 may compute the results of Equation 1 using a relatively small number of computations.

Figure 5:
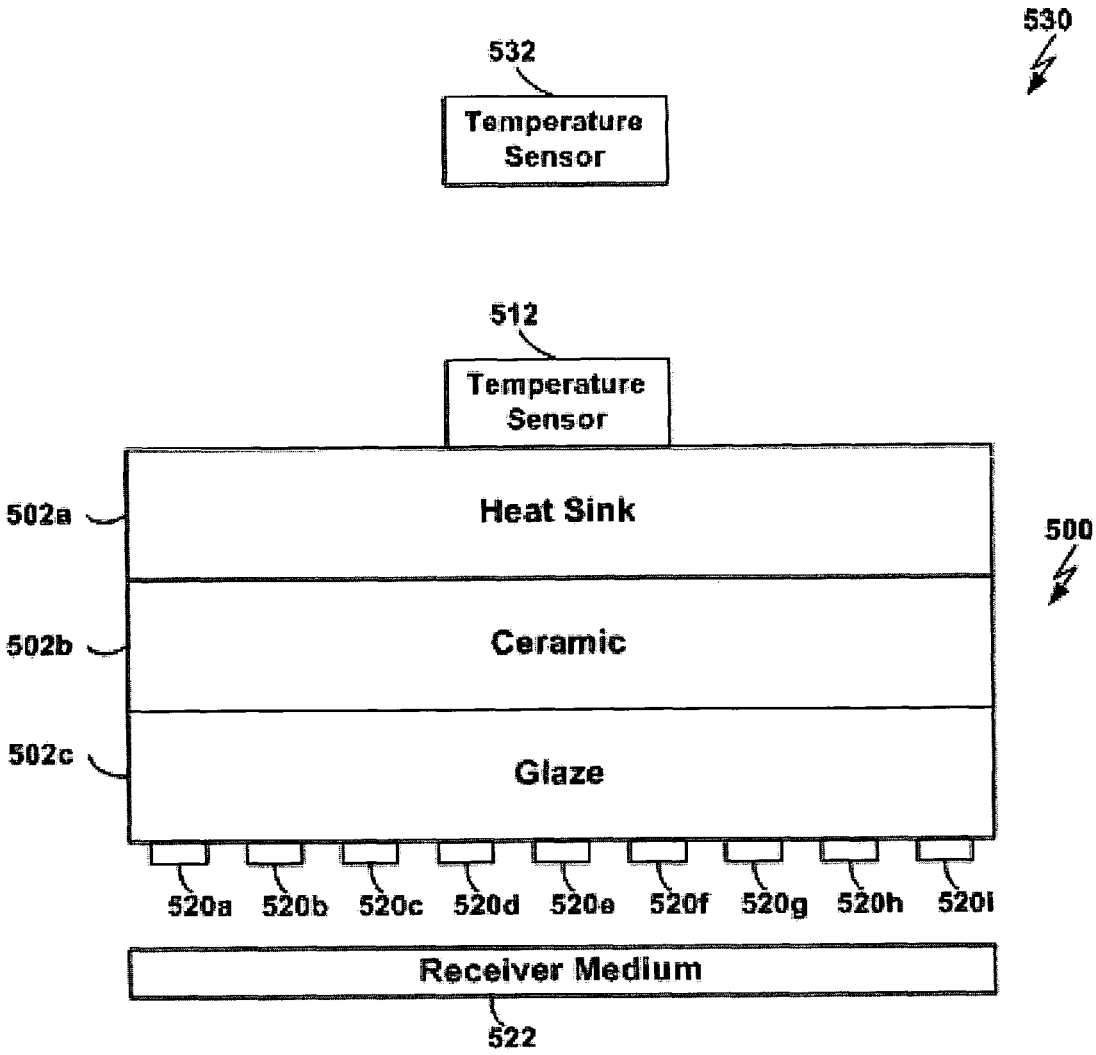
FIG. 5 is a schematic side view of a portion of a thermal printer including a thermal print head according to one embodiment of the present invention.

One embodiment of the head temperature model 202 (FIGS. 2-3) is now described in more detail. Referring to FIG. 5, a schematic side view is shown of a portion 530 of the thermal printer 108 including a thermal print head 500. The print head 500 includes several layers, including a heat sink 502*a*, ceramic 502*b*, and glaze 502*c*. Underneath the glaze 502*c* is a linear array of print head elements 520*a-i*. It should be appreciated that although only nine heating elements 520*a-i* are shown in FIG. 5 for ease of illustration, a typical thermal print head will have hundreds of very small and closely-spaced print head elements per inch. The print head elements 520*a-i* produce output on a receiver medium 522.

As described above, energy may be provided to the print head elements 520*a-i* to heat them, thereby causing them to transfer pigment to an output medium. Heat generated by the print head elements 520*a-i* diffuses upward through the layers 502*a-c*.

It may be difficult or unduly burdensome to directly measure the temperatures of the individual print head elements 520*a-i* over time (e.g., while a digital image is being printed). Therefore, in one embodiment of the present invention, rather than directly measuring the temperatures of the print head elements 520*a-i*, the head temperature model 202 is used to predict the temperatures of the print head elements 520*a-i* over time. In particular, the head temperature model 202 may predict the temperatures of the print head elements 520*a-i* by modeling the thermal history of the print head elements 520*a-i* using knowledge of: (1) the temperature of the print head 500, and (2) the energy that has been previously provided to the print head elements 520*a-i*. The temperature of the print head 500 may be measured using a temperature sensor 512 (such as a thermistor) that measures the temperature $T_s$(n) at some point on the heat sink 512.

The head temperature model 202 may model the thermal history of the print head elements 520*a-i* in any of a variety of ways. For example, in one embodiment of the present invention, the head temperature model 202 uses the temperature $T_s$(n) measured by temperature sensor 512, in conjunction with a model of heat diffusion from the print head elements 520*a-i* to the temperature sensor 512 through the layers of the print head 500, to predict the current temperatures of the print head elements 520*a-i*. It should be appreciated, however, that the head temperature model 202 may use techniques other than modeling heat diffusion through the print head 500 to predict the temperatures of the print head elements 520*a-i*. Examples of techniques that may be used to implement the head temperature model 202 are disclosed in more detail in the above-referenced patent application entitled "Thermal Response Correction System."

As mentioned above, the techniques disclosed in the above-referenced patent application entitled "Thermal Response Correction System" do not explicitly account for changes in ambient printer temperature or humidity. Rather, the method was calibrated with data collected at a particular ambient printer temperature and humidity. The parameters of the thermal printer model 302 and inverse media model 206 were then estimated to minimize the mean square error between the model predictions and the data. This yields an accurate model for describing thermal history effects at a reference set of ambient conditions.

Examples of techniques will now be disclosed for modifying the above-described techniques to explicitly account for changes in ambient conditions. In particular, techniques will be disclosed for: (1) modeling the effects of ambient temperature fluctuations explicitly to enable the correction of thermal effects at a wide range of ambient temperatures; and (2) correcting for thermal effects of humidity variations.

Recall that the 2-D function E=F(d,$T_h$) may be approximated by a linear combination of the 1-D functions G(d) and S(d), as shown in Equation 1. The arguments $T_h$ and d denote the absolute temperature of the print head element at the beginning of the print cycle (line time) and the desired print density, respectively. The required energy E should depend on the temperature of the receiver medium, and not the head temperature as shown in Equation 1. However, the form of Equation 1 remains the same even if we use the media temperature, as long as the temperature of the medium under the print head is a linear function of the head element temperature. Rewriting Equation 1 in terms of media temperature that is linearly related to the head element temperature $T_h$ results in Equation 2.

$$E=G'(d)+S'(d)T_m \quad \text{Equation 2}$$

In Equation 2, $T_m$ denotes the absolute temperature of the media, and the functions G'(·) and S'(·) are related to the G(·) and S(·) functions, respectively, in Equation 1. The functions G'(·) and S'(·) may be estimated using, for example, techniques disclosed in the above-referenced patent application for estimating the functions G(·) and S(·).

In various embodiments of the present invention, the media temperature $T_m$ is estimated by modeling the heat diffusion occurring within the print head and receiver medium. In one embodiment of the present invention, such temperature estimation is performed by translating the heat diffusion problem into an equivalent electrical circuit problem.

Figure 6:
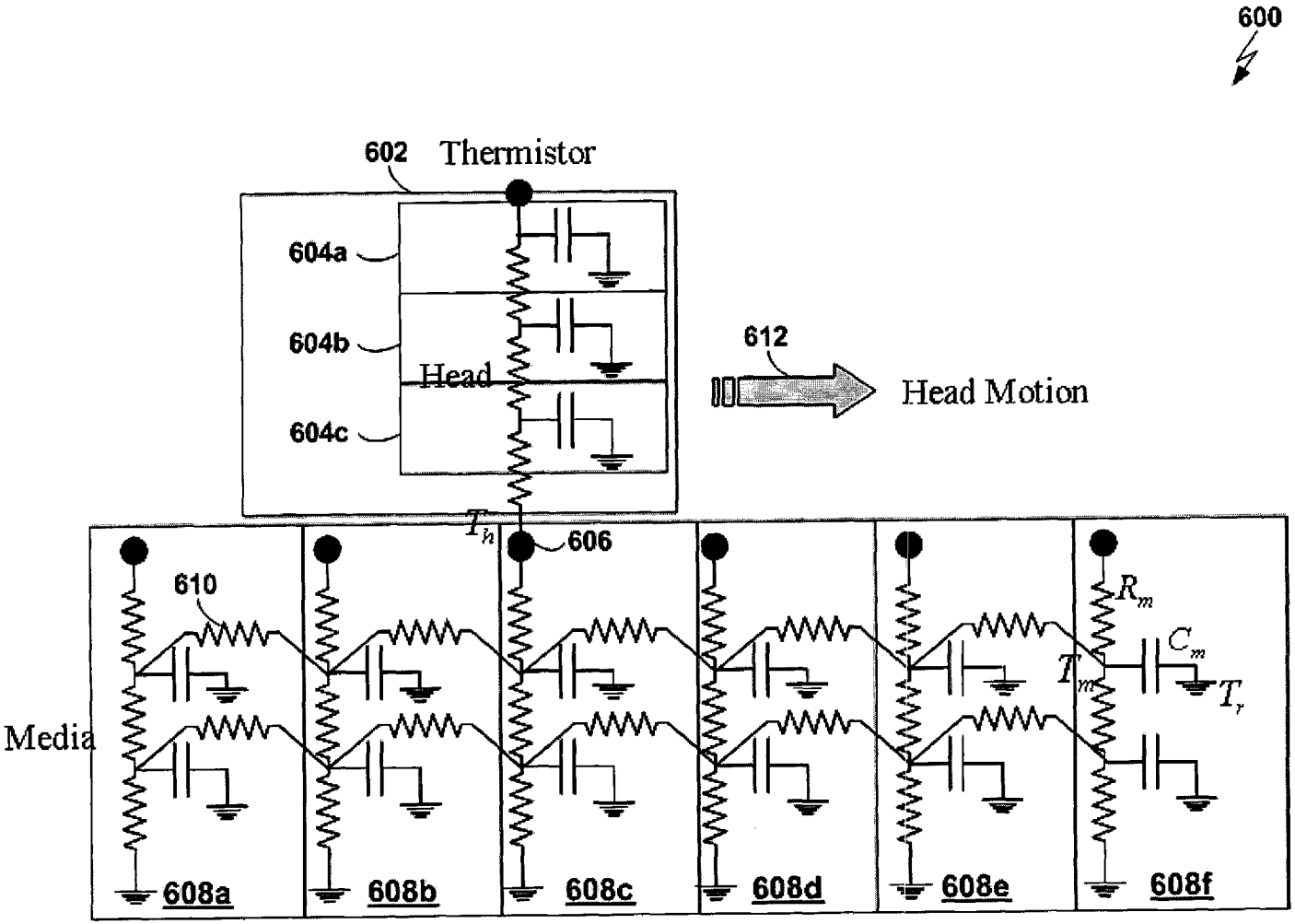
FIG. 6 is a schematic diagram of a circuit that models heat diffusion through a receiver medium according to one embodiment of the present invention.

Referring to FIG. 6, an example of such an electrical circuit 600 is shown according to one embodiment of the present invention. The thermal resistance, heat capacity, heat flow, and temperature in the media translate to electrical resistance, capacitance, current, and voltage, respectively, in the elements of the circuit 600. Such a mapping facilitates the computation of as well as the graphical representation of the heat diffusion problem.

An RC circuit network 602 in the circuit 600 (FIG. 6) models the print head 500 (FIG. 5). In particular, RC circuits 604*a-c* model the layers 502*a-c*, respectively, of the print head 500. The voltage at node 606 models the predicted print head element temperature $T_h$. Note, however, that there need not be a one-to-one mapping between circuits 604*a-c* and layers 502*a-c*. Rather, a single layer in the print head 500 may be modeled by multiple circuits, and a single circuit may model multiple layers in the print head 500. The receiver medium 522 is modeled by a plurality of RC circuit networks 608*a-f*. The circuit network 608*c* coupled directly to node 606 models the portion of the medium 522 directly below the print head element. Adjacent ones of the circuit networks 608*a-f* model adjacent portions of the receiver medium 522 in the direction covered by the print head 500 in successive print cycles.

The circuit 600 illustrated in FIG. 6 approximates the continuous motion of the print head 500 over the receiving medium 522 as discrete steps taken by the head 500 during a line time (print cycle) in the direction indicated by arrow 612. Referring again to FIG. 5, note that the printer 530 may include a second temperature sensor 532 for sensing the ambient printer temperature $T_r$ inside of the printer 530. When the head 500 moves over a fresh region of the medium 522 at the start of a line, the initial temperature of the new region $T_m$ is very close to the ambient temperature $T_r$ measured by the temperature sensor 532. Although circuit networks 608*a-f* include cross-network resistors (such as resistor 610) to model lateral heat diffusion within the medium 522, such resistors are not taken into consideration in the present analysis because it is assumed that within the short print cycle there is little heat diffusion occurring in the printing direction within the medium 522. Such resistors could be taken into account however, if it were desired to consider the effects of this heat diffusion within the medium 522.

As heat starts to flow from the head 500 to the medium 522, the media temperature $T_m$ begins to rise. The rate of heat flow will be proportional to the temperature gradient between the head 500 and the media 522. The final media temperature $T_m$ will depend on the line time $\Delta t$ and the time constant of the media 522 given by $R_mC_m$. For short line times, the media temperature $T_m$ can be approximated by Equation 3:

$$T_m \approx T_r + A_m(T_h - T_r) \qquad \text{Equation 3}$$

$A_m$ in Equation 3 is given by Equation 4:

$$A_m = \frac{\Delta t}{R_m C_m} \qquad \text{Equation 4}$$

Plugging Equation 3 into Equation 2, we obtain Equation 5:

$$E = G'(d) + S'(d)T_r(1 - A_m) + S'(d)A_mT_h \qquad \text{Equation 5}$$

Comparing Equation 1 and Equation 5, we obtain Equation 6 and Equation 7:

$$G(d, T_r) = G'(d) + S'(d)(1 - A_m)T_r \qquad \text{Equation 6}$$

$$S(d) = S'(d)A_m \qquad \text{Equation 7}$$

Note that in Equation 6 the implicit dependence of the original G(·) function on $T_r$ has been made explicit.

Figure 4:
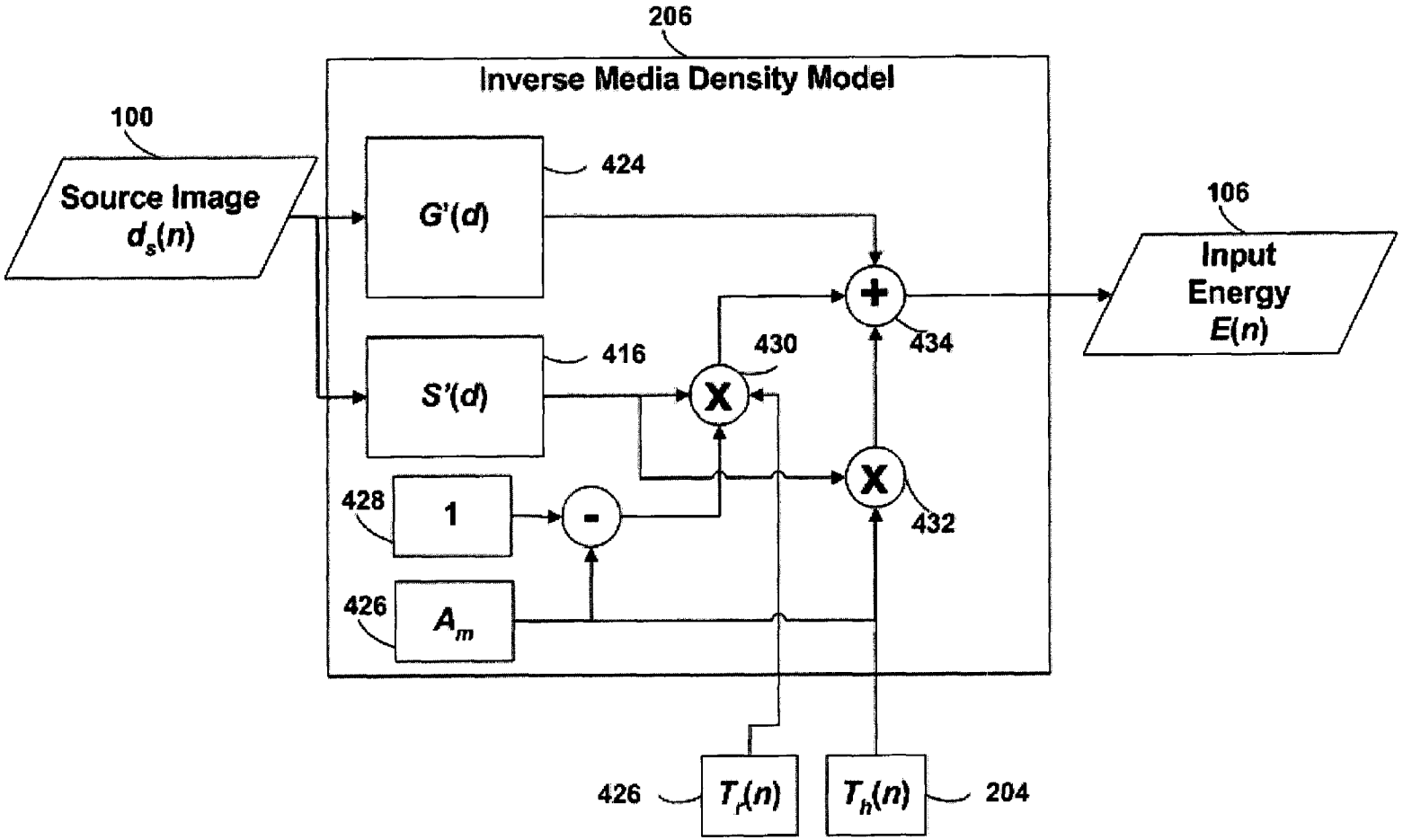
FIG. 4 is a data flow diagram of an inverse media density model used in one embodiment of the present invention.

For example, referring to FIG. 4, one embodiment of the inverse media density model 206 (FIG. 2) is now described in more detail. The inverse media density model 206 receives as inputs during each time interval n: (1) the source image densities $d_s(n)$ 100, (2) $T_h(n)$ 204, the predicted temperatures of the thermal print head elements at the beginning of time interval n; and $T_r(n)$, the ambient printer temperature at the beginning of time interval n. The inverse media density model 206 produces as an output the input energy E(n) 106. In other words, the transfer function defined by the inverse media density model 206 shown in FIG. 4 is a three-dimensional function $E=F(d,T_h,T_r)$.

It may be seen from FIG. 4 that the inverse media density model 206 illustrated in FIG. 4 implements Equation 5. For example, the model 206 includes a function G'(·) 424 and a function S'(·) 416. A first multiplier 430 multiplies S'(·) 416, $T_r(n)$ 426, and $(1-A_m)$ to produce the second term in Equation 5. A second multiplier 432 multiplies S'(·) 416, $A_m$ 426, and $T_h(n)$ 204 to produce the third term in Equation 5. An adder 434 adds G'(·) to the outputs of the first and second multipliers 430 and 432 to produce the input energy E(n) 106.

Figure 7A:
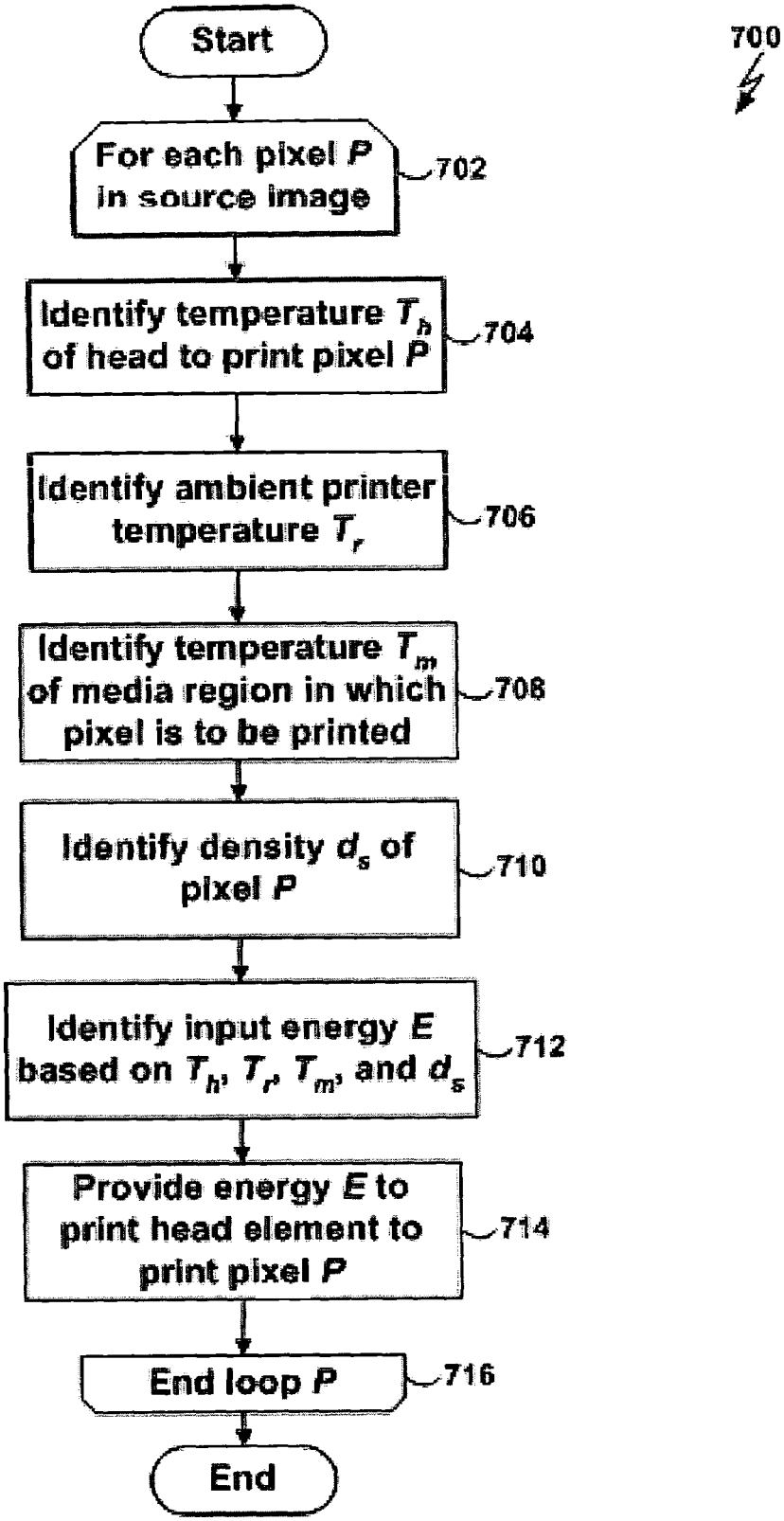
FIGS. 7A-7F are flowcharts of methods for printing digital images using thermal history control according to various embodiments of the present invention.

Referring to FIG. 7A, a flowchart is shown of a method 700 that is performed by the inverse printer model 102 in one embodiment of the present invention to produce the input energy 106 to provide to the thermal printer 108 to produce the printed image 110. The method 700 enters a loop over each pixel P in the source image 100 (step 702). The method 700 identifies the temperature $T_h$ of the print head element that is to print pixel P (step 704). The temperature $T_h$ may, for example, be predicted using the techniques disclosed in the above-referenced patent application or using techniques disclosed herein.

The method 700 identifies the ambient printer temperature $T_r$ (step 706). The ambient printer temperature $T_r$ may, for example, be identified by measurement using the temperature sensor 532.

The method 700 identifies the temperature $T_m$ of the region of the print medium 522 in which pixel P is to be printed (step 708). The temperature $T_m$ may, for example, be estimated using Equation 3.

The method 700 identifies the density $d_s$ of pixel P (step 710). The method 700 identifies the input energy E required to print pixel P based on the identified print head element temperature $T_h$, ambient printer temperature $T_r$, media region temperature $T_m$, and density $d_s$ (step 712). The energy E may, for example, be identified using Equation 5. The method 700 provides energy E to the appropriate print head element, thereby causing pixel P to be printed (step 714). The method 700 repeats steps 704-714 for the remaining pixels P in the source image 100 (step 716), thereby printing the remainder of the source image 100.

Note that step 708 (identification of the media temperature $T_m$) need not be performed as a separate step in the method 700. For example, if $T_m$ is estimated using Equation 3, then identification of $T_m$ is performed implicitly in step 712 based on $T_h$ and $T_r$.

Figure 7B:
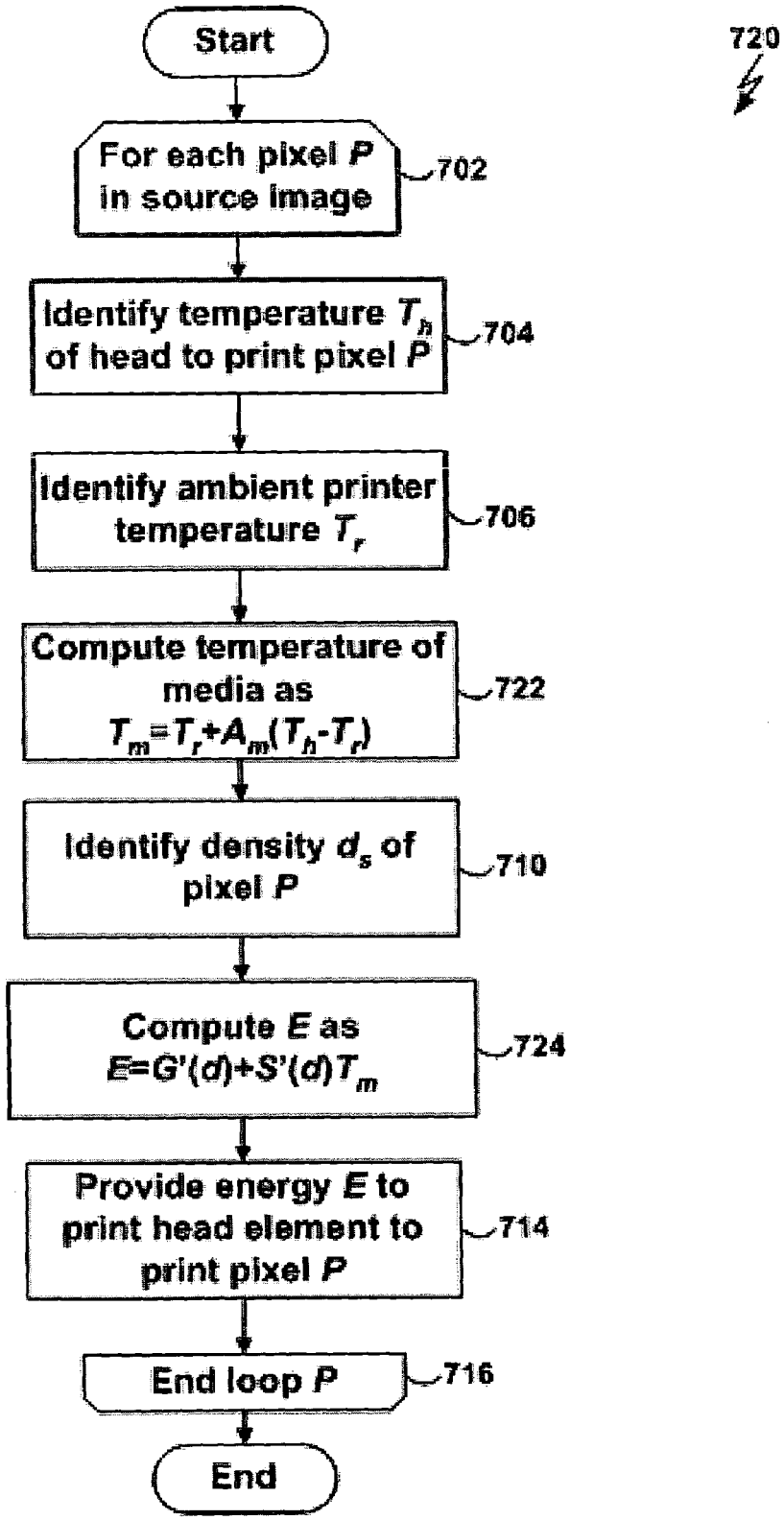

The method 700 illustrated in FIG. 7A may be implemented in a variety of ways. For example, referring to FIG. 7B, a flowchart is shown of a method 720 that is used in one embodiment of the present invention to implement the method 700 of FIG. 7A. The method 720 includes the same steps 702-706 as the method 700 illustrated in FIG. 7B. The method 720, however, identifies the media temperature $T_m$ for each pixel P by computing the value of $T_m$ using Equation 3 (step 722). The method 720 identifies the density $d_s$ of pixel P (step 710) and computes the required energy E by substituting the computed value of $T_m$ into Equation 2. One advantage of the method 720 illustrated in FIG. 7B is that, by computing media temperature $T_m$ for each pixel P, changes in the ambient printer temperature $T_r$ may be taken into account on a line-by-line basis.

Figure 7C:
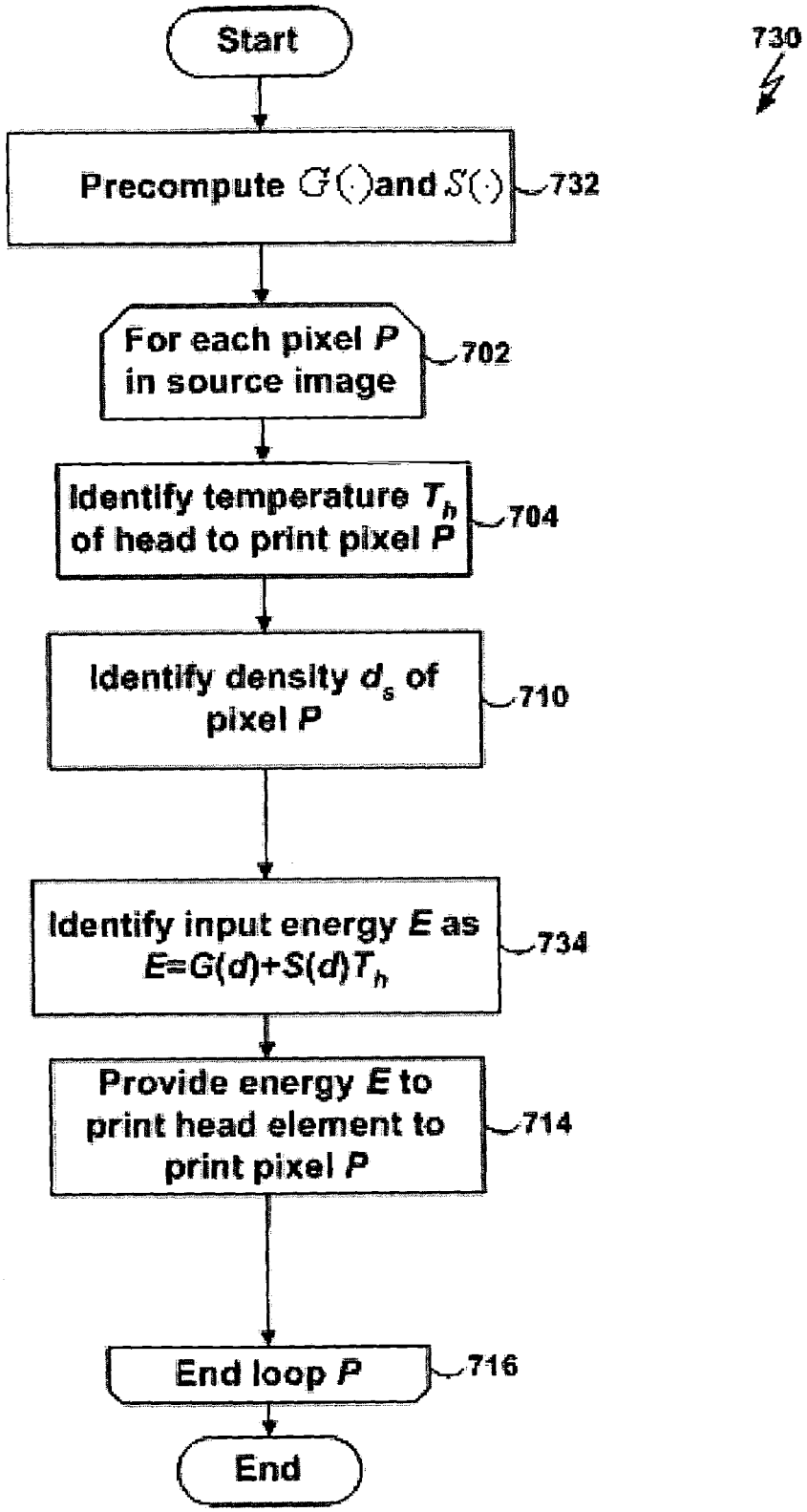

Taking changes in the ambient printer temperature $T_r$ into account on a line-by-line basis, however, may not provide a significant benefit, since the ambient printer temperature $T_r$ will typically have a long time constant. Referring to FIG. 7C, a flowchart is shown of another method 730 that is used in one embodiment of the present invention to implement the method 700 of FIG. 7A with increased computational efficiency by eliminating the ability to take ambient printer temperature changes into account during a print job.

The method 730 precomputes the functions G(·) and S(·) using Equation 6 and Equation 7 prior to calculating the individual pixel energies (step 732). If the ambient printer temperature $T_r$ is not expected to change appreciably during printing, the use of a single value of $T_r$ in the precomputation performed in step 732 will not have an appreciable effect on the output produced in the remainder of the method 730.

The method 730 enters a loop over each pixel P in the source image 100 (step 702) and identifies the temperature $T_h$ of the corresponding print head element (step 704). The method 730 identifies the density $d_s$ of pixel P (step 710). The method 730 may omit steps 706 and 708 (FIG. 7A), because the effect produced by such steps is achieved by the precomputation performed in step 732.

Having precomputed the functions G(·) and S(·), the method 730 identifies the input energy E using Equation 1, which only requires the density $d_s$ and the print head temperature $T_h$ as inputs (step 734), thereby implementing step 712 of the method 700 shown in FIG. 7A. It may be appreciated that Equation 1, which requires only two table lookups, a single addition, and a single multiplication, may be computed more efficiently than the combination of Equation 2 and Equation 3 used in the method 720 of FIG. 7B.

The method 730 provides the energy E to the print head element (step 714) and repeats steps 704, 710, 734, and 714 for the remaining pixels P (step 716).

Figure 7D:
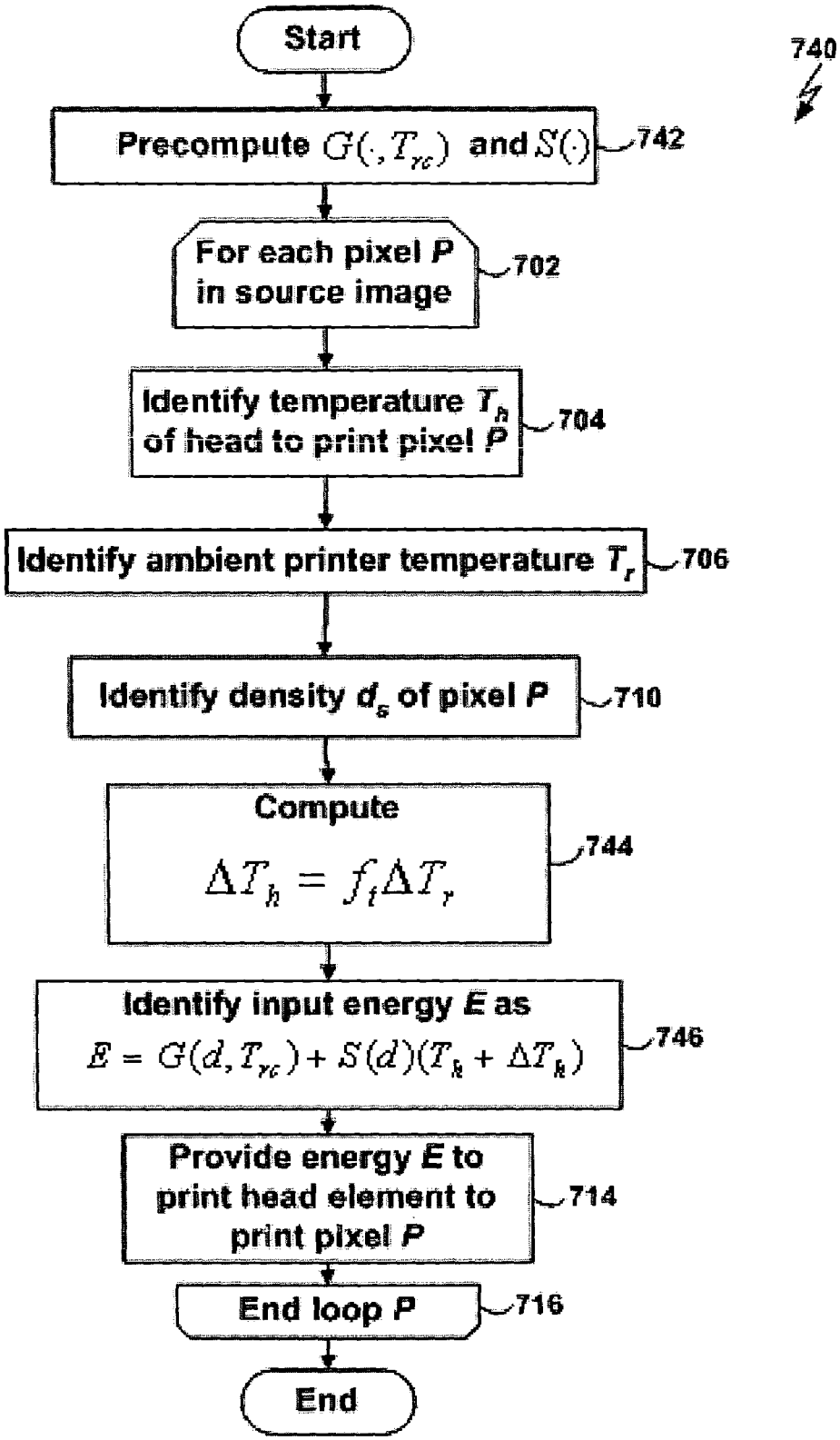

Referring to FIG. 7D, a flowchart is shown of a method 740 that is used in another embodiment of the present invention to implement the method 700 illustrated in FIG. 7A. The method 740 retains the ability to take ambient temperature into account, but with greater computational efficiency than the method 720 illustrated in FIG. 7B. Let $T_{rc}$ be the ambient temperature at which the inverse media density model 206 is calibrated. Let $f_l=(1-A_m)/A_m$. Using Equation 5, Equation 6, and Equation 7, we obtain Equation 8:

$$\begin{aligned} E &= G'(d) + S'(d)(1-A_m)T_{rc} + \\ &\quad S'(d)(1-A_m)(T_r - T_{rc}) + S'(d)A_m T_h \\ &= G(d, T_{rc}) + S(d)(T_h + f_l \Delta T_r) \end{aligned} \qquad \text{Equation 8}$$

In Equation 8, $\Delta T_r=T_r-T_{rc}$. In other words, Equation 8 allows ambient temperature changes to be taken into account when computing the input energy E by using a correction term $\Delta T_h$, added to the print head element temperature $T_h$, based on the difference between the current ambient printer temperature $T_r$ and the calibration temperature $T_{rc}$. The correction term $\Delta T_h$ is given by Equation 9.

$$\Delta T_h = f_l \Delta T_r \qquad \text{Equation 9}$$

Referring to FIG. 7D, in one embodiment of the present invention lookup tables are precomputed for the functions $G(.,T_{rc})$ and S(·) (step 742). The method 740 enters a loop over each pixel P in the source image 100 (step 702), identifies the temperature $T_h$ of the print head element (step 704), identifies the ambient printer temperature $T_r$ (step 706), and identifies the density $d_s$ of the pixel P (step 710). Equation 9 is used to compute the value of the correction term $\Delta T_h$ for pixel P (step 744). The method 740 uses Equation 8 to compute the input energy E by adding the computed correction term $\Delta T_h$ to the absolute temperature $T_h$ and by using the lookup tables to obtain values for $G(d,T_{rc})$ and S(d) (step 746). The method 740 provides the input energy E to the print head element (step 714) and repeats steps 704, 710, 744, 746, and 714 for the remaining pixels in the source image 100 (step 716).

The addition of the correction term $\Delta T_h$ to the print head element temperature $T_h$ in step 746 may, however, be eliminated by recognizing that the computation of the absolute temperatures $T_h$ by the thermal history control algorithm includes adding the relative temperatures of all the layers of the print head 500 to the thermistor reading obtained (by temperature sensor 512) at the coarsest layer, as described in more detail in the above-referenced patent application entitled "Thermal Response Correction System." Consequently, if the correction term $\Delta T_h$ is added to the thermistor reading $T_s$, the correction term $\Delta T_h$ is effectively propagated to every pixel by the thermal history control algorithm computation of the absolute print head element temperature $T_h$. Recall that $T_s$ denotes the temperature recorded by the thermistor 512. Then, a modified thermistor temperature $T_s'$ is given by Equation 10:

$$T_s' = T_s + f_l \Delta T_r \qquad \text{Equation 10}$$

The modified thermistor temperature $T_s'$ may then be used to compute the predicted print head element temperatures $T_h$ using the techniques disclosed in the above-referenced patent application, and thereby eliminating the need to add the correction term $\Delta T_h$ for each pixel in the computation of the input energy E.

Figure 7E:
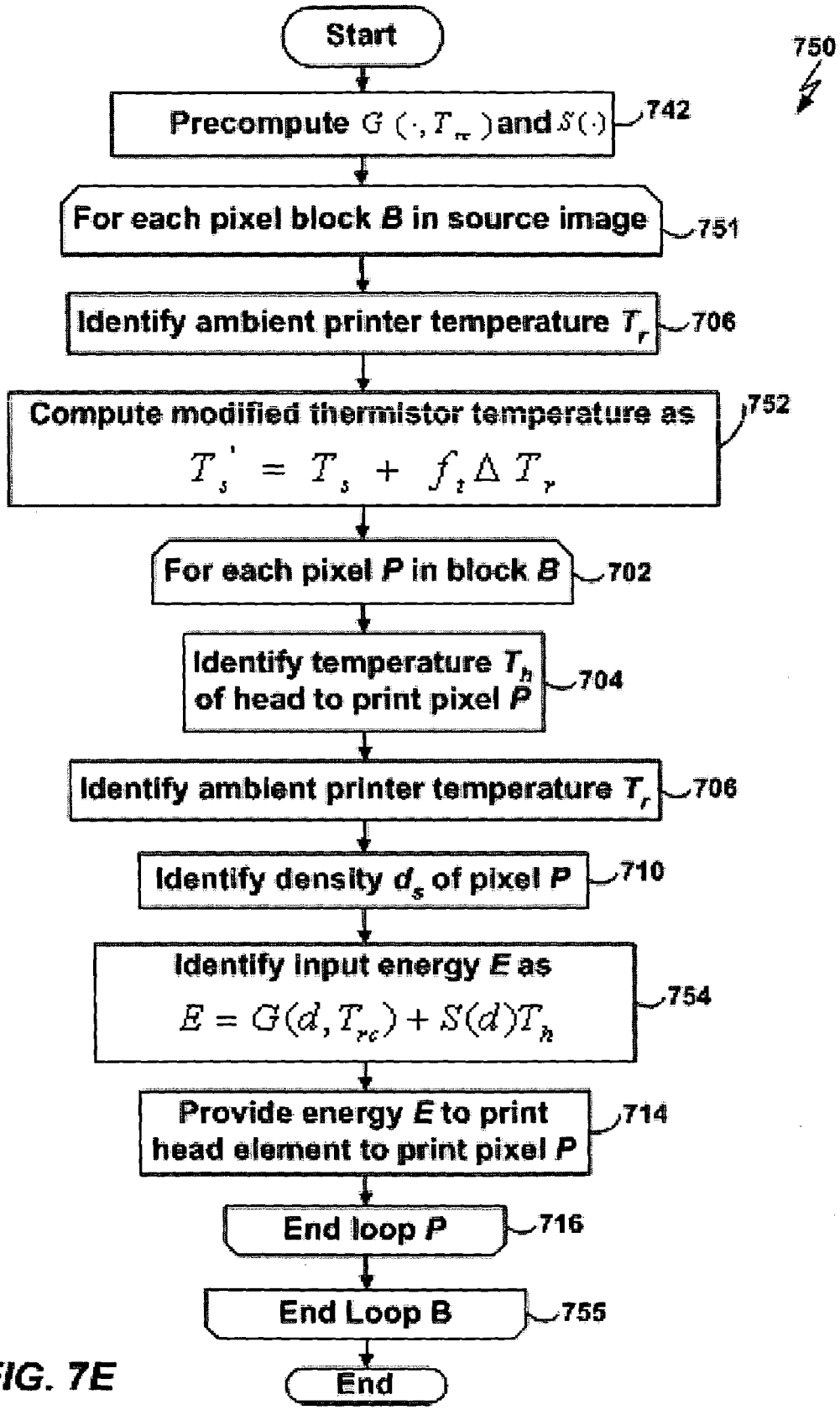

More specifically, referring to FIG. 7E, a flowchart is shown of a method 750 that is used in one embodiment of the present invention to perform the same function as the method 740 shown in FIG. 7D, but without the addition performed in step 746. The method 750 precomputes lookup tables for the functions $G(.,T_{rc})$ and S(·) (step 742), as described above with respect to FIG. 7D. The method 750 enters a loop over each block B of pixels in the source image 100 (step 751). A block of pixels may, for example, be a subset of the source image 100 or the entire source image 100.

The method 750 identifies the ambient printer temperature $T_r$ (step 706). The method 750 computes the modified print head temperature $T_s'$ based on the current ambient printer temperature $T_r$ and the calibration ambient printer temperature $T_{rc}$ using Equation 10 (step 752).

The method 750 enters a loop over each pixel P in the block B (step 702), as described above with respect to FIG. 7A. The method 750 identifies the temperature $T_h$ of the print head element that is to print pixel P (step 704), identifies the ambient printer temperature $T_r$ (step 706), and identifies the density $d_s$ of pixel P (step 710). Step 708 (FIG. 7A) need not be performed because the media temperature $T_m$ was taken into account implicitly in step 752.

The method 750 computes the input energy E using Equation 11 (step 754). Note that Equation 11 results from removing the correction term $\Delta T_h$ from Equation 10 because $\Delta T_h$ was taken into account in the computation of the modified print head temperature $T_s'$ in step 752.

$$E = G(d, T_{rc}) + S(d)T_h \qquad \text{Equation 11}$$

The method 750 provides the input energy E to the print head element (step 714) and repeats steps 704, 710, 754, and 714 for the remaining pixels in the source image 100 (step 716). The method 750 repeats the steps described above for the remaining blocks in the source image 100 (step 755).

One advantage of the method 750 illustrated in FIG. 7E is that it has negligible overhead in terms of run-time computation, since calculating Equation 11 requires only two table lookups, one addition, and one multiplication, which is no more computationally intensive than Equation 1.

Furthermore, the method 750 has the ability to take into account changes in the ambient printer temperature $T_r$ during a long print job, if required. Such changes are reflected in the print head element temperatures $T_h$ identified in step 704.

Changes in humidity may affect the densities in the printed image 110 produced by the thermal printer 108 (FIG. 1). The effects of humidity variation on the printed density, however, may be difficult to represent if humidity alters the media model 206 in such a complex manner that it cannot be accommodated by the structure imposed in Equation 2. As may be seen from the discussion above, the media model 206 may easily be used to account for any variations in the ambient printer temperature $T_r$. In one embodiment of the present invention, the effect of humidity is taken into account by translating it into an equivalent temperature variation.

Using the techniques described in U.S. Pat. No. 6,537,410, entitled "Thermal Transfer Recording System," printing may be achieved by melting the thermal solvent in the donor layer that in turn dissolves the dye. The dissolved dye is then drawn into the receiver by capillary action. Ideally, the thermal solvent melts at a fixed temperature. The presence of impurities in the media, however, may influence the melting temperature. We hypothesize that the moisture in the air is absorbed by the donor layer and lowers the melting point of the thermal solvent. The amount of moisture absorbed by the donor layer is driven by the ambient relative humidity. Therefore, in one embodiment of the present invention a temperature correction is applied that is proportional to the change in relative humidity.

Let ΔRH denote the difference between the current relative humidity and the relative humidity for which the media model 206 was calibrated. Equation 10, which calculates the modified print head temperature measurement $T_s'$, may be modified to take into account the humidity effect as shown in Equation 12.

$$T_s'=T_s+f_l\Delta T_r+f_h(T_r)\Delta RH \qquad \text{Equation 12}$$

In Equation 12, $f_h(\cdot)$ denotes the proportionality constant that converts the relative humidity change ΔRH into an equivalent temperature change. We have experimentally observed that humidity has a larger effect at higher ambient temperatures. The dependence of $f_h(\cdot)$ on $T_r$ is meant to reproduce this change in sensitivity to humidity with temperature.

Note that Equation 12 shows a particular form of the correction term that is added to the print head temperature $T_s$. In general, this correction term may be written as a two-dimensional function $f(T_r,\Delta RH)$, where the functional dependence of the correction term on $T_r$ and ΔRH takes a different form than that shown in Equation 12. The value of this function at a particular ambient printer temperature and relative humidity may be found experimentally by determining the modified print head temperature that results in a printed image most similar to the image printed under the reference ambient conditions. Experimental procedures can also be used to determine the values of $f_t$ and $f_h(\cdot)$.

Figure 7F:
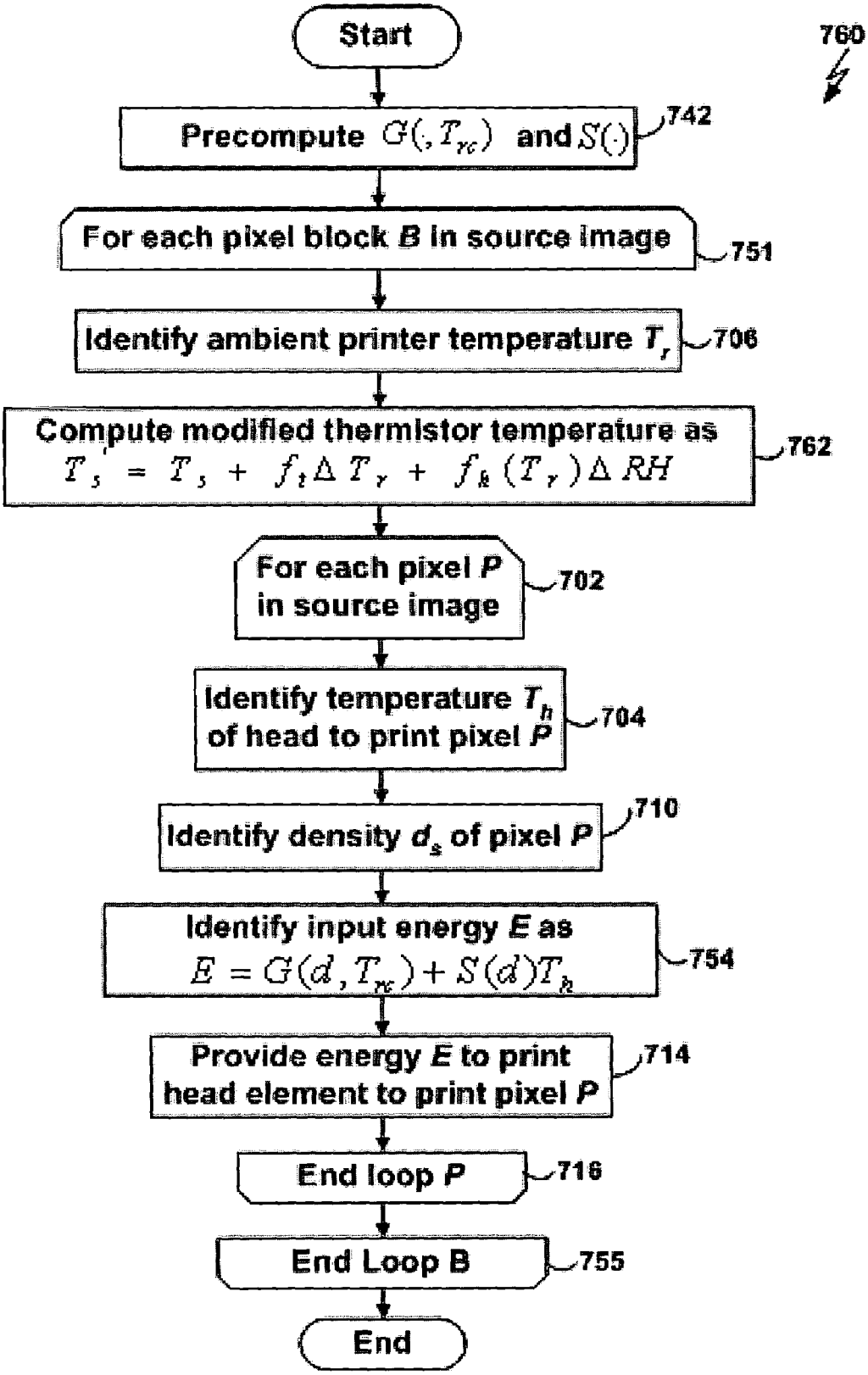

Referring to FIG. 7F, a flowchart is shown of a method 760 that is used in one embodiment of the present invention to perform the same function as the method 750 shown in FIG. 7E, except that the method 760 shown in FIG. 7F additionally takes changes in relative humidity into account. The method 760 precomputes lookup tables for the functions $G(.,T_{rc})$ and $S(\cdot)$ (step 742), as described above with respect to FIG. 7D. The method 760 enters a loop over each block B of pixels in the source image 100 (step 751). The method 760 identifies the ambient printer temperature $T_r$ (step 706).

The method 760 computes the modified print head temperature $T_s'$ based on the current ambient printer temperature $T_r$, the calibration ambient printer temperature $T_{rc}$, and the change in relative humidity ΔRH using Equation 12 (step 762). The remainder of the method 760 performs steps 702, 704, 710, 754, 714, 716, and 755 in the same manner as described above with respect to FIG. 7E, except that the input energy E calculated in step 754 in FIG. 7F effectively takes the effects of humidity into account because the modified print head temperature $T_s'$ produced in step 762 reflects the effects of humidity, and because the modified print head temperature $T_s'$ in turn influences the print head element temperatures $T_h$ identified in step 704 for the reasons described above.

An alternative hypothesis is that the glass transition temperature $T_g$ of the dye layer changes as a function of relative humidity. The rate at which the dye is drawn into the receiver is a function of the viscosity, which in turn is a function of $T_g$. Based on these premises, one may develop a formula for calculating the equivalent change in temperature that is again proportional to relative humidity, and in which the proportionality constant has a quadratic dependence on the ambient temperature. Note that the form of the humidity correction term to the thermistor temperature given in Equation 12 accommodates this hypothesis as well.

The techniques disclosed herein have a variety of advantages. As described above, ambient temperature changes that occur after the thermal history control algorithm has been calibrated can cause the printer to produce suboptimal output if such changes are not taken into account. By taking ambient temperature changes into account explicitly when computing the input energies to provide to a printer to print an image, the techniques disclosed herein compensate for such temperature changes, thereby improving the quality of the printed output.

Similarly, as described above, changes in humidity that occur after the thermal history control algorithm has been calibrated can cause the printer to produce suboptimal output if such changes are not taken into account. By taking humidity changes into account explicitly when computing the input energies to provide to a printer to print an image, the techniques disclosed herein compensate for such temperature changes, thereby improving the quality of the printed output.

Furthermore, the techniques disclosed herein have the advantages disclosed in the above-referenced patent application entitled "Thermal History Control." For example, the techniques disclosed herein reduce or eliminate the problem of "density drift" by taking the current ambient temperature of the print head and the thermal and energy histories of the print head into account when computing the energy to be provided to the print head elements, thereby raising the temperatures of the print head elements only to the temperatures necessary to produce the desired densities. A further advantage of various embodiments of the present invention is that they may either increase or decrease the input energy provided to the print head elements, as may be necessary or desirable to produce the desired densities.

Another advantage of various embodiments of the present invention is that they compute the energies to be provided to the print head elements in a computationally efficient manner. For example, as described above, in one embodiment of the present invention, the input energy is computed using two one-dimensional functions (G(d) and S(d)), thereby enabling the input energy to be computed more efficiently than with the single four-dimensional function $F(d,T_h,T_r,\Delta RH)$.

It is to be understood that although the invention has been described above in terms of particular embodiments, the foregoing embodiments are provided as illustrative only, and do not limit or define the scope of the invention. Various other embodiments, including but not limited to the following, are also within the scope of the claims. For example, elements and components described herein may be further divided into additional components or joined together to form fewer components for performing the same functions.

Although some embodiments may be described herein with respect to thermal transfer printers, it should be appreciated that this is not a limitation of the present invention. Rather, the techniques described above may be applied to printers other than thermal transfer printers (e.g. direct thermal printers). Furthermore, various features of thermal printers described above are described merely for purposes of example and do not constitute limitations of the present invention.

It should be appreciated that the results of the various equations shown and described above may be generated in any of a variety of ways. For example, such equations (such as Equation 1) may be implemented in software and their results calculated on-the-fly. Alternatively, lookup tables may be pre-generated which store inputs to such equations and their corresponding outputs. Approximations to the equations may also be used to, for example, provide increased computational efficiency. Furthermore, any combination of these or other techniques may be used to implement the equations described above. Therefore, it should be appreciated that use of terms such as "computing" and "calculating" the results of equations in the description above does not merely refer to on-the-fly calculation but rather refers to any techniques which may be used to produce the same results.

The techniques described above may be implemented, for example, in hardware, software, firmware, or any combination thereof. The techniques described above may be implemented in one or more computer programs executing on a programmable computer including a processor, a storage medium readable by the processor (including, for example, volatile and non-volatile memory and/or storage elements), at least one input device, and at least one output device. Program code may be applied to input entered using the input device to perform the functions described and to generate output. The output may be provided to one or more output devices.

Each computer program within the scope of the claims below may be implemented in any programming language, such as assembly language, machine language, a high-level procedural programming language, or an object-oriented programming language. The programming language may, for example, be a compiled or interpreted programming language.

Each such computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output. Suitable processors include, by way of example, both general and special purpose microprocessors. Generally, the processor receives instructions and data from a read-only memory and/or a random access memory. Storage devices suitable for tangibly embodying computer program instructions include, for example, all forms of non-volatile memory, such as semiconductor memory devices, including EPROM, EEPROM, and flash memory devices; magnetic disks such as internal hard disks and removable disks; magneto-optical disks; and CD-ROMs. Any of the foregoing may be supplemented by, or incorporated in, specially-designed ASICs (application-specific integrated circuits) or FPGAs (Field-Programmable Gate Arrays). A computer can generally also receive programs and data from a storage medium such as an internal disk (not shown) or a removable disk. These elements will also be found in a conventional desktop or workstation computer as well as other computers suitable for executing computer programs implementing the methods described herein, which may be used in conjunction with any digital print engine or marking engine, display monitor, or other raster output device capable of producing color or gray scale pixels on paper, film, display screen, or other output medium.

What is claimed is:

1. A computer-implemented method comprising steps of:

(A) identifying a first print head temperature $T_s$ of a print head in a printer;

(B) identifying a current ambient temperature $T_r$ in the printer;

(C) identifying a modified print head temperature $T_s'$ based on the first print head temperature $T_s$ and at least one property selected from the group consisting of the ambient printer temperature $T_r$ and a current relative humidity; and (D) identifying an input energy to provide to a print head element in the print head based on the modified print head temperature $T_s'$.

2. The method of claim 1, wherein the step (C) comprises steps of:

(C)(1) identifying a temperature $T_{rc}$ at which the method was calibrated; and (C)(2) identifying the modified print head temperature $T_s'$ based on at least one value selected from the group consisting of: (a)

the difference between the current ambient printer temperature $T_r$ and the calibration ambient printer temperature $T_{rc}$, and (b) the difference between the current relative humidity and a relative humidity at which the method was calibrated.

3. The method of claim 2, wherein the step (C) (2) comprises a step of identifying $T_s'$ using a formula selected from the group consisting of:

$$T_s' = T_s + \frac{(1 - A_m)}{A_m}\Delta T_r,$$

$$T_s' = T_s + f_h(T_r)\Delta RH, \text{ and}$$

$$T_s' = T_s + \frac{(1 - A_m)}{A_m}\Delta T + f_h(T_r)\Delta RH_r,$$

wherein $A_m$ is a constant, wherein $\Delta T_r$ is a difference between the current ambient printer temperature $T_r$ and an ambient printer temperature at which the method was calibrated, wherein $\Delta RH$ comprises a difference between the current relative humidity and a relative humidity at which the method was calibrated, and wherein $f_h(\ )$ comprises a proportionality constant that converts the relative humidity difference $\Delta RH$ into an equivalent temperature difference.

4. A device comprising:

first identification means for identifying a first print head temperature $T_s$ of a print head in a printer;

second identification means for identifying a current ambient temperature $T_r$ in the printer;

third identification means for identifying a modified print head temperature $T_s'$ based on the first print head temperatue $T_s$ and at least one property selected from the group consisting of the ambient printer temperature $T_r$ and a current relative humidity; and fourth identification means for identifying an input energy to provide to a print head element in the print head based on the modified print head temperature $T_s'$.

5. The device of claim 4, wherein the third identification means comprises:

fifth identification means for identifying a temperature $T_{rc}$, wherein $T_{rc}$ is a temperature at which the device was calibrated; and sixth identification means for identifying the modified print head temperature $T_s'$ based on at least one value selected from the group consisting of: (a) the difference between the current ambient printer temperature $T_r$ and the calibration ambient printer temperature $T_{rc}$, and (b) the difference between the current relative humidity and a relative humidity at which the device was calibrated.

6. The device of claim 5, wherein the sixth identification means comprises means for identifying $T_s'$ using a formula selected from the group consisting of:

$$T_s' = T_s + \frac{(1 - A_m)}{A_m}\Delta T_r,$$

$$T_s' = T_s + f_h(T_r)\Delta RH, \quad \text{and}$$

$$T_s' = T_s + \frac{(1 - A_m)}{A_m}\Delta T + f_h(T_r)\Delta RH_r,$$

wherein $A_m$ is a constant, wherein $\Delta T_r$ is a difference between the current ambient printer temperature $T_r$ and an ambient printer temperature at which the device was calibrated, wherein $\Delta RH$ comprises a difference between the current relative humidity and a relative humidity at which the device was calibrated, and wherein $f_h(\ )$ comprises a proportionality constant that converts the relative humidity difference $\Delta RH$ into an equivalent temperature difference.

* * * * *